US009272824B2

(12) United States Patent
Vogel et al.

(10) Patent No.: US 9,272,824 B2
(45) Date of Patent: Mar. 1, 2016

(54) FLEX HINGE CLOSURE WITH DRAIN-BACK CHANNEL

(71) Applicant: Gateway Plastics, Inc., Mequon, WI (US)

(72) Inventors: William C. Vogel, Mequon, WI (US); Richard A. Gross, Pewaukee, WI (US); Dieter F. Lay, Oconomowoc, WI (US)

(73) Assignee: GATEWAY PLASTICS, INC., Mequon, WI (US)

( * ) Notice: Subject to any disclaimer, the term of this patent is extended or adjusted under 35 U.S.C. 154(b) by 136 days.

(21) Appl. No.: 14/169,907

(22) Filed: Jan. 31, 2014

(65) Prior Publication Data

US 2015/0217910 A1 Aug. 6, 2015

(51) Int. Cl.

| | |
|---|---|
| ***B67D 1/16*** | (2006.01) |
| ***B65D 47/40*** | (2006.01) |
| ***B65D 47/08*** | (2006.01) |
| ***B65D 47/10*** | (2006.01) |

(52) U.S. Cl.

CPC ..... *B65D 47/40* (2013.01); *B65D 47/0814* (2013.01); *B65D 47/103* (2013.01)

(58) Field of Classification Search

CPC .. B65D 47/0871; B65D 47/106; B65D 47/40; B65D 47/0857; B65D 47/0861; B65D 47/0866; B65D 47/10

USPC ..... 222/109, 111, 556, 562, 568, 571, 222/153.07, 541.9

See application file for complete search history.

(56) References Cited

U.S. PATENT DOCUMENTS

| | | | | | |
|---|---|---|---|---|---|
| 838,536 | A | * | 12/1906 | Haffey | 222/109 |
| 3,168,221 | A | * | 2/1965 | Parker | 222/109 |
| 3,208,650 | A | * | 9/1965 | La Ham | 222/543 |
| 3,610,484 | A | * | 10/1971 | Matzka | 222/479 |
| 4,022,357 | A | * | 5/1977 | Dwinell | 222/537 |
| 4,356,939 | A | * | 11/1982 | Fitte | 222/541.9 |
| D292,882 | S | * | 11/1987 | Gross | D9/435 |
| 5,141,138 | A | * | 8/1992 | Odet et al. | 222/153.07 |
| 5,301,849 | A | * | 4/1994 | Guglielmini et al. | 222/517 |
| 5,358,151 | A | * | 10/1994 | Strasenburgh | 222/420 |
| 5,735,426 | A | * | 4/1998 | Babcock et al. | 220/258.2 |
| 6,039,224 | A | * | 3/2000 | Dallas et al. | 222/565 |
| 6,305,563 | B1 | * | 10/2001 | Elliott | 215/235 |
| 6,367,670 | B1 | * | 4/2002 | Warner et al. | 222/556 |
| 6,390,342 | B1 | * | 5/2002 | Mabee | 222/541.9 |

(Continued)

FOREIGN PATENT DOCUMENTS

| | | | | | |
|---|---|---|---|---|---|
| CH | 683985 | A5 | * | 6/1994 | B65D 47/08 |
| EP | 621199 | A1 | * | 10/1994 | B65D 47/08 |
| JP | 01023960 | A | * | 1/1989 | B65D 51/22 |

*Primary Examiner* — Patrick M Buechner

(74) *Attorney, Agent, or Firm* — Foley & Lardner LLP

(57) ABSTRACT

A flex hinge closure with a drain-back channel includes a base portion having a dispensing aperture, a raised pour lip formed along a perimeter of the dispensing aperture, a raised rib forming a closed shape surrounding the raised pour lip, and a drain-back channel defined by a space between the raised pour lip and the raised rib. The drain-back channel collects excess material dispensed via the dispensing aperture and drains the excess material back to a receptacle. The closure further includes a cap portion hingedly connected to the base portion. The cap portion rotates relative to the base portion about the hinged connection between a closed position in which the cap portion covers the dispensing aperture and an open position in which the cap portion uncovers the dispensing aperture.

18 Claims, 14 Drawing Sheets

(56) References Cited

U.S. PATENT DOCUMENTS

| | | | | |
|---|---|---|---|---|
| 6,510,971 | B1 * | 1/2003 | Martin | 222/556 |
| 7,559,432 | B2 * | 7/2009 | Mavin et al. | 220/258.2 |
| D626,412 | S * | 11/2010 | Lohrman et al. | D9/449 |
| 7,963,409 | B2 * | 6/2011 | McGeough et al. | 215/256 |
| 2005/0205618 | A1 * | 9/2005 | Mabee et al. | 222/541.9 |
| 2011/0297698 | A1 * | 12/2011 | Chiang et al. | 222/109 |
| 2012/0241480 | A1 * | 9/2012 | Hindle et al. | 222/566 |

* cited by examiner

FLEX HINGE CLOSURE WITH DRAIN-BACK CHANNEL

BACKGROUND

The present disclosure relates generally to a closure for a container for storing and dispensing materials (e.g., liquids, particulate matter, etc.). The present disclosure relates more specifically to a closure having a flexible hinge and a drain-back channel for recapturing material collected around a dispensing aperture of the closure.

It is generally known to provide a cover or closure on a container used for storing and dispensing liquids, particulate matter (e.g., granulated, powdered, etc.), or other fluid-like materials. For example, containers with closures are often used to store and dispense foodstuffs, seasonings, condiments, beverage additives (e.g., creamer, sugar, flavored powders, etc.) or other materials such as those displayed and sold in supermarkets. Such a closure typically attaches to an open end of a receptacle and has at least one dispensing aperture for dispensing the material retained with the receptacle.

SUMMARY

One implementation of the present disclosure is a closure for a receptacle having a top opening. The closure includes a base portion configured to attach to an upper portion of the receptacle to cover the top opening. The base portion includes a dispensing aperture, a raised pour lip formed along a perimeter of the dispensing aperture, a raised rib forming a closed shape surrounding the raised pour lip, and a drain-back channel defined by a space between the raised pour lip and the raised rib. The drain-back channel is configured to collect excess material dispensed via the dispensing aperture and to drain the excess material back to the receptacle. The closure further includes a cap portion hingedly connected to the base portion. The cap portion is configured to rotate relative to the base portion about the hinged connection between a closed position in which the cap portion covers the dispensing aperture and an open position in which the cap portion uncovers the dispensing aperture.

In some embodiments, the perimeter of the dispensing aperture includes a portion occupied by the raised pour lip and a portion not occupied by the raised pour lip. In some embodiments, the drain-back channel is configured to drain the excess material back to the receptacle through the portion of the perimeter of the dispensing aperture not occupied by the raised pour lip.

In some embodiments, the closure further includes a break-away tab releasably attached to the base portion along an inner perimeter of the dispensing aperture. The break-away tab may cover the dispensing aperture in a sealed arrangement. The closure may further include a pull ring fixedly attached to an upper surface of the break-away tab and configured to separate the break-away tab from the base portion when a pulling force is applied to the pull ring. The break-away tab and the pull ring may be configured to completely detach from the base portion when the break-away tab is separated therefrom. In some embodiments, a perimeter of the pull ring is substantially aligned with a perimeter of the break-away tab and the pull ring is offset above the break-away tab. In some embodiments, the break-away tab includes a concave depression recessed into the upper surface thereof. The concave depression may be configured to receive an object for applying the pulling force to the pull ring.

In some embodiments, the closure includes a first material which forms an integrated inner core of the base portion and a second material which forms an integrated component including the cap portion and an outer shell of the base portion. The cap portion may be hingedly connected to the outer shell of the base portion. In some embodiments, the integrated inner core of the base portion includes the raised pour lip, the raised rib surrounding the raised pour lip, and one or more features configured to attach the base portion to the receptacle.

In some embodiments, the cap portion includes an inner perimeter seal configured to engage a perimeter of the raised pour lip when the cap portion is in the closed position and an outer perimeter seal configured to engage a perimeter of the raised rib when the cap portion is in the closed position.

Another implementation of the present disclosure is a closure for a receptacle having a top opening. The closure includes a base portion configured to attach to an upper portion of the receptacle to cover the top opening. The base portion includes a dispensing aperture and a raised rib forming a closed shape surrounding the dispensing aperture. The raised rib is offset from a perimeter of the dispensing aperture. The closure further includes a cap portion hingedly connected to the base portion. The cap portion is configured to rotate relative to the base portion about the hinged connection between a closed position in which the cap portion covers the dispensing aperture and an open position in which the cap portion uncovers the dispensing aperture. The cap portion includes an inner perimeter seal configured to form a seal along a perimeter of the dispensing aperture when the cap portion is in the closed position and an outer perimeter seal configured to form a seal along a perimeter of the raised rib when the cap portion is in the closed position.

In some embodiments, the raised rib and the outer perimeter seal are circular. In some embodiments, the outer perimeter seal is configured to shrink in a predictable manner when the closure is formed.

In some embodiments, the inner perimeter seal and the outer perimeter seal extend from an inside surface of the cap portion. The inner perimeter seal may form an inner perimeter wall and the outer perimeter seal may form an outer perimeter wall surrounding the inner perimeter wall. The inner perimeter wall may have a first height in a direction of extension from the inside surface and the outer perimeter wall may have a second height in the direction of extension from the inside surface. The first height may exceed the second height.

In some embodiments, the outer perimeter seal includes a first snap ring along a circumferential surface of the outer perimeter seal and the raised rib includes a second snap ring along a circumferential surface of the raised rib. The first snap ring may be configured to engage the second snap ring when the cap portion is moved into the closed position. The snap rings may be configured to hold the cap portion in the closed position.

In some embodiments, the base portion includes a raised pour lip formed along a perimeter of the dispensing aperture. The inner perimeter seal may be configured to engage a perimeter of the raised pour lip when the cap portion is in the closed position.

In some embodiments, the base portion includes a drain-back channel between the inner perimeter seal and the outer perimeter seal. The drain-back channel may be configured to collect excess material dispensed via the dispensing aperture and to drain the excess material back to the receptacle.

In some embodiments, the outer perimeter seal and the inner perimeter seal have a seal thickness. The outer perimeter seal may be offset from the inner perimeter seal by an amount between twice the seal thickness and ten times the seal thickness. The outer perimeter seal may be shorter than the inner perimeter seal by an amount between half the seal thickness and five times the seal thickness.

Another implementation of the present disclosure is a closure for a receptacle having a top opening. The closure includes a base portion configured to attach to an upper portion of the receptacle to cover the top opening. The base portion includes a dispensing aperture. The closure further includes a cap portion hingedly connected to the base portion by a central hinge connection and a pair of periphery hinge connections surrounding the central hinge connection. The cap portion is configured to rotate relative to the base portion about the hinged connections between a closed position in which the cap portion covers the dispensing aperture and an open position in which the cap portion uncovers the dispensing aperture.

In some embodiments, the cap portion includes a perimeter seal extending from an inner surface of the cap portion. The perimeter seal may be configured to form a seal around the dispensing aperture when the cap portion is in the closed position. The cap portion may further include an anti-fling rib extending from the inner surface of the cap portion. The anti-fling rib may be surrounded by the perimeter seal. The anti-fling rib may have a curved profile which curves radially inward as the anti-fling rib extends from the inner surface.

In some embodiments, the base portion includes an attachment feature configured to secure the base portion to the receptacle. The attachment feature includes at least one of threading and ratchet teeth.

In some embodiments, the base portion includes an inner core and an outer shell overmolded onto the inner core. The outer shell may be restrained from motion relative to the inner core by a geometric fitting between the outer shell and the inner core. In some embodiments, the outer shell is restrained from lateral motion relative to the inner core by a tongue and groove fitting. In some embodiments, the outer shell is restrained from rotation relative to the inner core by one or more locking elements geometrically integrated with the tongue and groove fitting.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
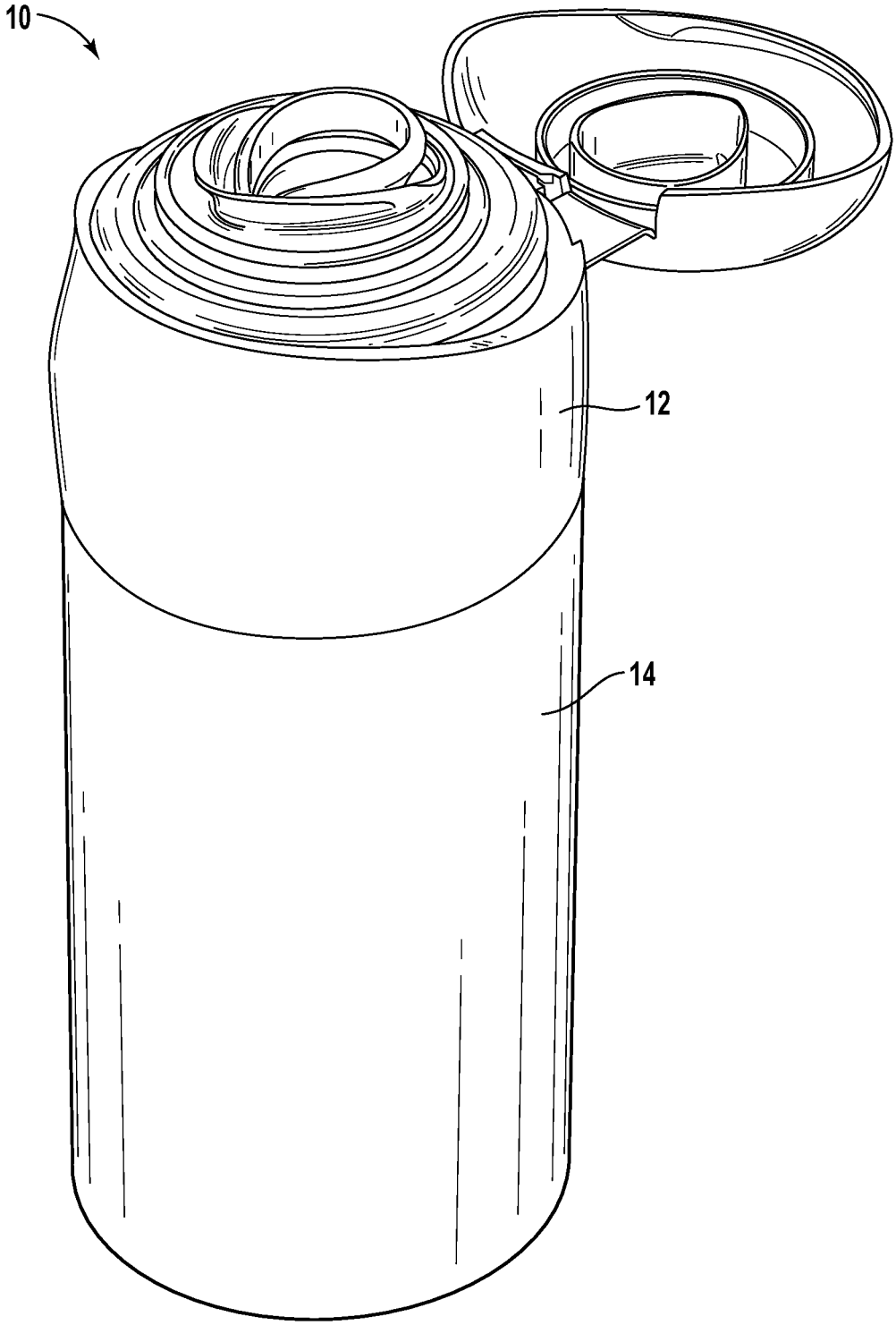
FIG. 1 is drawing of a container having a receptacle and a closure for use in conjunction with the receptacle for storing and dispensing matter, according to an exemplary embodiment.

Referring generally to the FIGURES, a closure for a container is shown, according to various exemplary embodiments. The closure may be used in conjunction with an open receptacle to form a container for storing and dispensing matter. For example, the closure may be attached to a receptacle (e.g., to the open end of a receptacle having a top opening) to facilitate storing and dispensing various types of liquids, particulate matter (e.g., granulated, powdered, etc.), and/or other fluids or fluid-like materials. In various implementations, the closure may be used to store and dispense foodstuffs (e.g., cheeses, seasonings, spices, condiments), beverages, beverage additives (e.g., creamer, sugar, flavored powders, etc.) or other materials such as those displayed and sold in supermarkets.

The closure includes a base portion having a dispensing aperture through which material within the receptacle can be dispensed. In some embodiments, the base portion includes a raised pour lip formed around a perimeter of the dispensing aperture. The base portion may include a raised rib surrounding the raised pour lip and a drain-back channel defined by a space between the raised pour lip and the raised rib. Advantageously, the drain-back channel may be configured to collect excess material dispensed via the dispensing aperture and to drain the excess material back to the receptacle.

The closure includes a cap portion hingedly attached to the base portion. The cap portion may be configured to rotate relative to the base portion (e.g., about the hinged connection) between a closed position and an open position. In the closed position, the cap portion covers the dispensing aperture. In the open position, the cap portion uncovers the dispensing aperture and allows material to be dispensed from the container. The cap portion may include one or more perimeter seals configured to engage corresponding components of the base portion when the cap portion is in the closed position. For example, the cap portion may include an inner perimeter seal configured to form a seal along a perimeter of the dispensing aperture (e.g., along a perimeter of the raised pour lip) and an outer perimeter seal configured to form a seal along a perimeter of the raised rib. In some embodiments, the inner perimeter seal is taller than the outer perimeter seal.

In some embodiments, the closure is formed using a multi-shot injection molding process. For example, the container may include an inner core formed from a first material (e.g., low density polyethylene or other relatively soft materials) and an outer shell formed from a second material (e.g., polypropylene or other relatively hard or rigid materials). Advantageously, forming the inner core from a relatively soft material may provide improved seal functionality over traditional closures. For example, the softer inner core may allow the inner perimeter seal and the outer perimeter seal to more effectively engage the raised pour lip and the raised rib. In some embodiments, the outer perimeter seal and the raised rib are circular. By forming the outer perimeter seal and raised rib as circles, the final (e.g., post-cooling) shapes and/or sizes of such components can be predicted and used to ensure a proper sealing arrangement.

Before discussing the details of the closure and/or the components thereof, it should be noted that references to "front," "back," "rear," "side," "upper," "lower," "inner," "outer," "right," and "left" in this description are merely used to identify the various elements as they are oriented in the FIGURES. These terms are not meant to limit the element which they describe, as the various elements may be oriented differently in various applications.

Referring now to FIG. 1, a closure 12 for a container 10 is shown, according to an exemplary embodiment. Closure 12 may be used in conjunction with a receptacle 14 to store and dispense various materials. For example, closure 12 may be attached to receptacle 14 (e.g., to an open end of a receptacle 14) to facilitate storing and dispensing various types of liquids, particulate matter (e.g., granulated, powdered, etc.), and/or other fluids or fluid-like materials. In various implementations, closure 12 may be used to store and dispense foodstuffs (e.g., cheeses, seasonings, spices, condiments), beverages, beverage additives (e.g., creamer, sugar, flavored powders, etc.) or other materials such as those displayed and sold in supermarkets. Closure 12 may be configured to fit over an opening of receptacle 14 (e.g., a top opening, a side opening, etc.) to form container 10. In some embodiments, closure 12 attaches to an upper portion of receptacle 14 to cover a top opening of receptacle 14.

Figure 2:
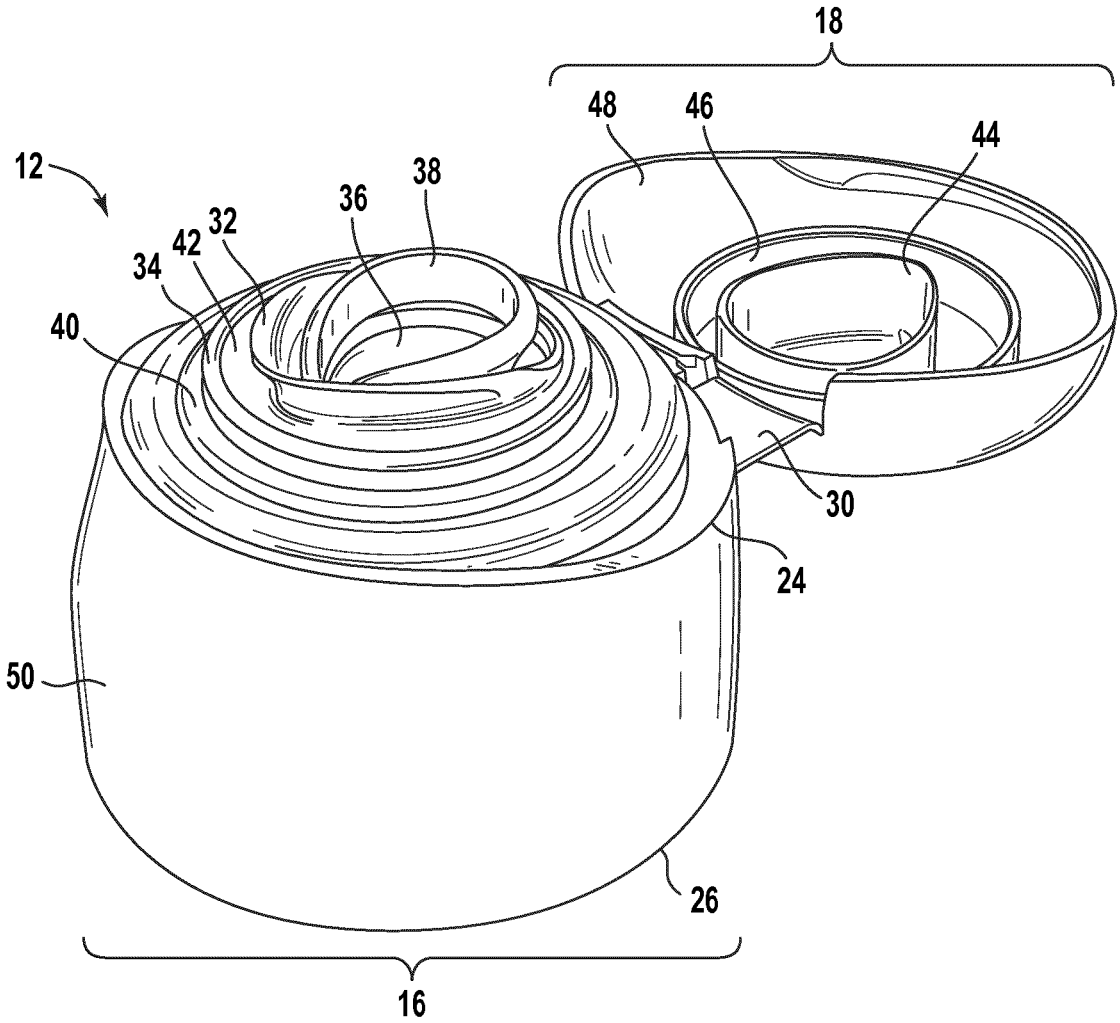
FIG. 2 is a drawing illustrating the closure of FIG. 1 in greater detail including a base portion and a cap portion hingedly connected to the base portion, showing the cap portion in an open position, according to an exemplary embodiment.
Figure 3:
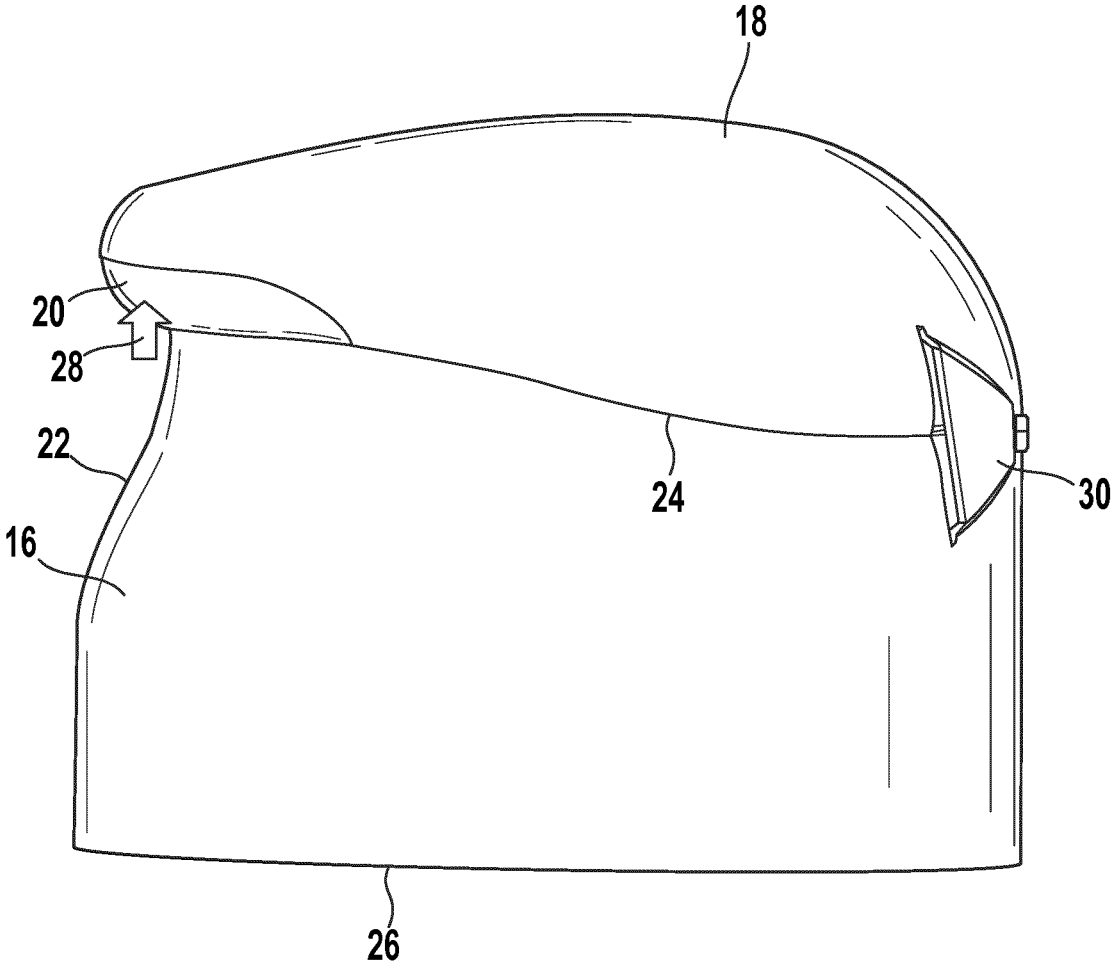
FIG. 3 is a drawing of the closure of FIG. 1, showing the cap portion in a closed position, according to an exemplary embodiment.

Referring now to FIGS. 2-3, closure 12 is shown to include a base portion 16 and a cap portion 18. Base portion 16 and cap portion 18 may be connected by one or more hinges 30. Cap portion 18 may be configured to rotate relative to base portion 16 (e.g., about hinges 30) between an open position (shown in FIG. 2) and a closed position (shown in FIG. 3). In some embodiments, an end 20 of cap portion 18 overhangs base portion 16. For example, as shown in FIG. 3, end 20 may extend beyond an upper rim 24 of base portion 16 when cap portion 18 is in the closed position. An upward force 28 can be applied to end 20 to cause cap portion 18 to move from the closed position toward the open position.

Base portion 16 is shown to include a lower rim 26 and an upper rim 24. In some embodiments, base portion 16 has a curved or slanted profile 22 which causes upper rim 24 to be narrower than lower rim 26. For example, lower rim 26 may circumscribe upper rim 24 when base portion 16 is viewed from above. In other embodiments, rims 24 and 26 may have the same or similar shapes and/or sizes. For example, base portion 16 may be cylindrical or substantially cylindrical. Upper rim 24 and lower rim 26 may be connected by a side wall 50. In some embodiments, base portion 16 has an open bottom. Side wall 50 may form a skirt adapted to fit over an end of receptacle 14.

Referring particularly to FIG. 2, base portion 16 is shown to include a raised pour lip 32. Raised pour lip 32 may be formed along a perimeter of a dispensing aperture. In FIG. 2, base portion 16 is shown with a break-away tab 36 occupying the dispensing aperture. Break-away tab 36 may be an integral part of base portion 16 when base portion 16 is formed. For example, break-away tab 36 and base portion 16 may be components of a unitary part formed from a single mold. When closure 12 is initially opened, break-away tab 36 can be separated from base portion 16 by applying a pulling force to pull ring 38. Pull ring 38 may be fixedly attached to an upper surface of break-away tab 36 and configured to separate break-away tab 36 from base portion 16 when a pulling force is applied to pull ring 38. Break-away tab 36 and pull ring 38 may be configured to completely detach from base portion 16 when break-away tab 36 is separated from base portion 16. Upon separating break-away tab 36 and pull ring 38 from base portion 16, the contents of container 10 can be dispensed via the dispensing aperture.

Raised pour lip 32 extends upward from an upper surface 40 of base portion 16. In some embodiments, raised pour lip 32 occupies an entire perimeter of the dispensing aperture (e.g., forming a closed shape). In other embodiments, raised pour lip 32 occupies only a portion of the perimeter of the dispensing aperture (e.g., forming an open shape). Raised pour lip 32 may form an oblong or elongated shape (e.g., an oval, a teardrop, an elongated arc, etc.). In some embodiments, raised pour lip 32 has a curved profile. For example, raised pour lip 32 is shown curving radially outward (e.g., away from a center of the dispensing aperture) as raised pour lip 32 extends upward from upper surface 40.

Raised pour lip 32 may have a height which varies at different points along the perimeter of the dispensing aperture. For example, at some locations, raised pour lip 32 may be taller (i.e., extending further from upper surface 40) than at other locations. In some embodiments, the height of raised pour lip 32 is zero or substantially zero (e.g., level with upper surface 40) at one or more locations along the perimeter of the dispensing aperture. Advantageously, a minimal or zero height of raised pour lip 32 at some locations may allow excess material dispensed from container 10 to drain back into container 10 via the dispensing aperture. In some embodiments, upper surface 40 is sloped to guide the excess material to a location at which raised pour lip 32 has a minimal or zero height.

Still referring to FIG. 2, base portion 16 is shown to include a raised rib 34. Raised rib 34 extends upward from upper surface 40. In some embodiments, raised rib 34 forms a closed shape surrounding raised pour lip 32. For example, raised rib 34 may form a circle or other closed shape which circumscribes raised pour lip 32. Advantageously, a circular shape for raised rib 34 may ensure that raised rib 34 shrinks uniformly and/or predictably when base portion 16 cools from an initial molded shape (e.g., after being injection molded). Raised rib 34 may have a uniform or substantially uniform height. At various points, raised rib 34 may be taller or shorter than raised pour lip 32 due to the variable height of raised pour lip 32.

In some embodiments, base portion 16 includes a drain-back channel 42. Drain-back channel 42 may be defined by a space between raised pour lip 32 and raised rib 34. Drain-back channel 42 may form a moat surrounding the dispensing aperture. In some embodiments, drain-back channel 42 is configured to collect excess material dispensed via the dispensing aperture. For example, when the material within container 10 is dispensed, excess material may adhere to an edge of raised pour lip 32. The excess material may be captured in drain-back channel 42 (e.g., between raised pour lip 32 and raised rib 34) and prevented from spilling or dripping.

Drain-back channel 42 may be configured to drain the excess material back into receptacle 14. For example, a lower surface of drain-back channel 42 may be sloped to guide the excess material collected therein to a location at which raised pour lip 32 has a minimal or zero height. The excess material collected in drain-back channel 42 may return to receptacle 14 via the dispensing aperture.

Still referring to FIG. 2, cap portion 18 may be a shell having a concave inner surface 48. Cap portion 18 is shown to include an inner perimeter seal 44 and an outer perimeter seal 46. Inner perimeter seal 44 and outer perimeter seal 46 may extend from inner surface 48. Perimeter seals 46 and 48 may be configured to engage corresponding components of base portion 16 when cap portion 18 is in the closed position. For example, inner perimeter seal 44 may be configured to form a seal along a perimeter of the dispensing aperture (e.g., along a perimeter of raised pour lip 32) and outer perimeter seal 46 may be configured to form a seal along a perimeter of raised rib 34. In some embodiments, inner perimeter seal 44 is taller than outer perimeter seal 46.

Inner perimeter seal 44 and outer perimeter seal 46 are shown forming closed shapes. The shapes of perimeter seals 44-46 may be adapted to match corresponding components of base portion 16. For example, inner perimeter seal 44 may form a closed shape matching the shape of the dispensing aperture and/or raised pour lip 32. Outer perimeter seal 46 may form a closed shape matching the shape of raised rib 34. In some embodiments, outer perimeter seal 46 forms a circle or other closed shape which circumscribes inner perimeter seal 44. Advantageously, a circular shape for outer perimeter seal 46 may ensure that outer perimeter seal 46 shrinks uniformly and/or predictably when cap portion 18 cools from an initial molded shape (e.g., after being injection molded).

Figure 4:
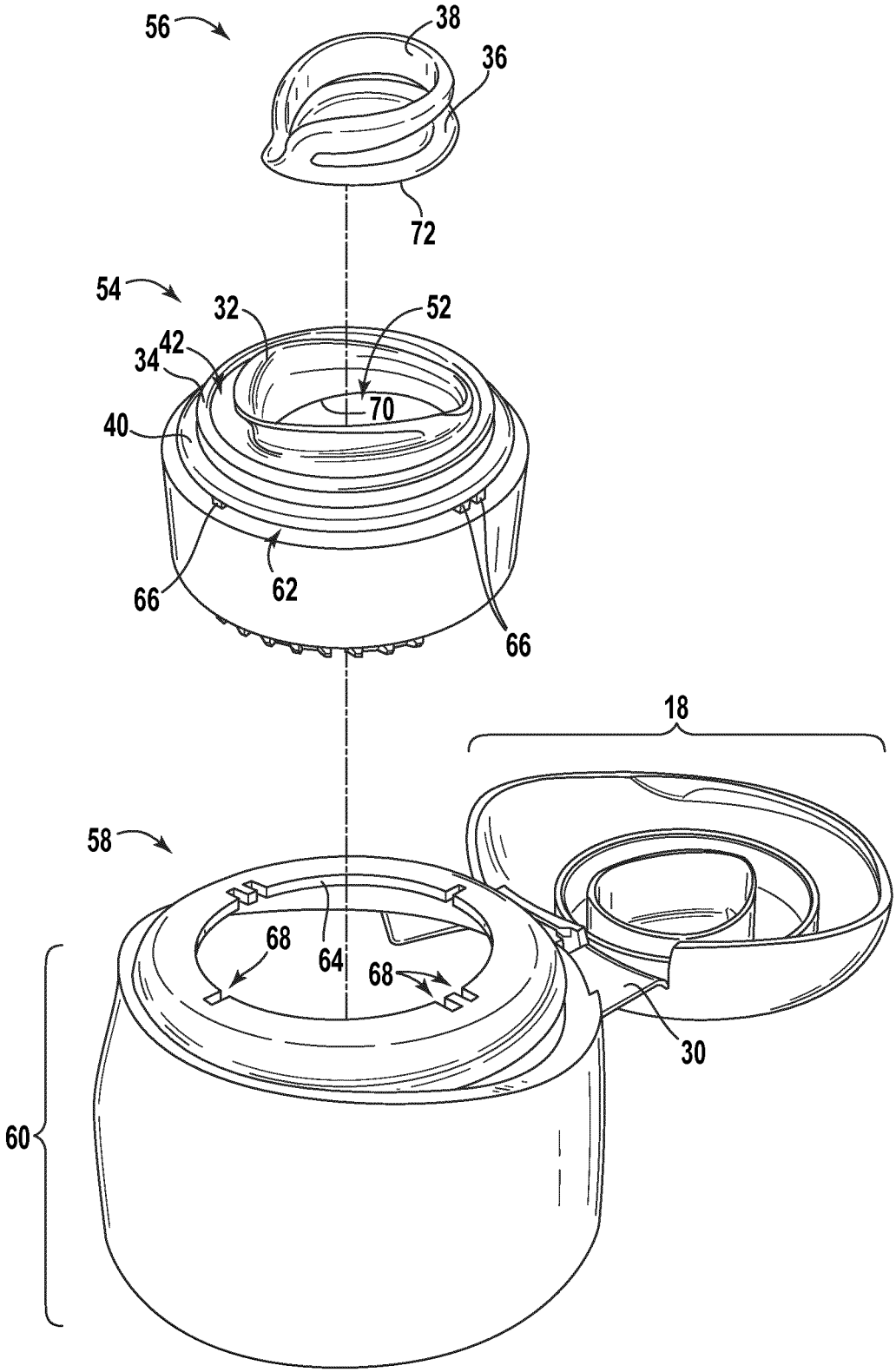
FIG. 4 is an exploded view drawing of the closure of FIG. 1 including an inner core, an overcap, and a break-away pull tab, according to an exemplary embodiment.

Referring now to FIG. 4, an exploded view of closure 12 is shown, according to an exemplary embodiment. Closure 12 is shown to include an inner core 54, a pull tab 56, and an overcap 58. In some embodiments, inner core 54 and pull tab 56 may be formed as an integrated component. For example, inner core 54 and pull tab 56 may be created using a molding process (e.g., injection molding) which creates a unitary part comprising both inner core 54 and pull tab 56. In some embodiments, inner core 54 and pull tab 56 are formed from a soft material such as low density polyethylene (LDPE) or another polymer material. Inner core 54 is shown to include raised pour lip 32, raised rib 34, upper surface 40, drain-back channel 42, and a dispensing aperture 52.

Upon initial formation, an outer rim 72 of break-away tab 36 may be attached to inner core 54 along a perimeter 70 of dispensing aperture 52. Break-away tab 36 may cover dispensing aperture 52 to protect and seal the contents of container 10. When closure 12 is initially opened (e.g., by a user), pull tab 56 can be separated from inner core 54 by applying a pulling force to pull ring 38. The pulling force may cause pull tab 56 to completely detach from inner core 54, thereby exposing dispensing aperture 52. Upon separating pull tab 56 from inner core 54, the contents of container 10 can be dispensed via dispensing aperture 52.

Overcap 58 may be created by overmolding a second material onto inner core 54 (e.g., using an injection molding process). In some embodiments, overcap 58 is formed from a relatively harder or more rigid material (relative to inner core 54) such as polypropylene (PP) or another polymer material. Overcap 58 may be an integrated (e.g., unitary) component which includes an outer shell 60 of base portion 16, cap portion 18, and/or hinges 30. Outer shell 60 and inner core 54 may combine to form base portion 16 (as shown in FIG. 2).

In some embodiments, outer shell 60 is restrained from motion relative to inner core 54 by a geometric fitting between outer shell 60 and inner core 54. For example, outer shell 60 is shown to include a tongue 64. Tongue 64 may be configured to fit within a corresponding groove 62 of inner core 54. In some embodiments, tongue 64 and groove 62 form a closed shape (e.g., circling inner core 54 and outer shell 60). Tongue 64 and groove 62 may restrain outer shell 60 from lateral motion (e.g., vertical translation, horizontal translation, etc.) relative to inner core 54. In various embodiments, other types of geometric fittings (e.g., pegs, notches, slots, flanges, etc.) or fasteners (e.g., adhesives, bolts, screws, rivets, pins, etc.) may be used in place of or in addition to tongue 64 and groove 62 to restrain outer shell 60 relative to inner core 54.

In some embodiments, outer shell 60 is restrained from rotation relative to inner core 54 by one or more locking elements. For example, inner core 54 is shown to include a plurality of locking pins 66. Locking pins 66 may be configured to fit within corresponding notches 68 of outer shell 60. In some embodiments, locking pins 66 and notches 68 may be geometrically integrated with the tongue and groove fitting. For example, locking pins 66 may be located within groove 62 and notches 68 may be located within tongue 64.

FIG. 4 shows four sets of notches 68 and locking pins 66 separated by approximately 90 degrees around tongue 64 and groove 62. Each set may include one or more locking pin 66 and one or more notch 68. For example, some sets of notches 68 and locking pins 66 are shown to include multiple notches 68 and locking pins 66 in close proximity. Close proximity notches 68 and locking pins 66 may be separated by a minimal distance (e.g., separated by a distance between one half and five times the width of locking pins 66 and/or notches 68). In various embodiments, any number and/or type of locking elements may be used in addition to or in place of notches 68 and locking pins 66 (e.g., geometric fittings, fasteners, etc.). Advantageously, notches 68 and locking pins 66 may prevent outer shell 60 from rotating relative to inner core 54 when closure 12 is attached (e.g., threaded) onto receptacle 14.

Figure 5A:
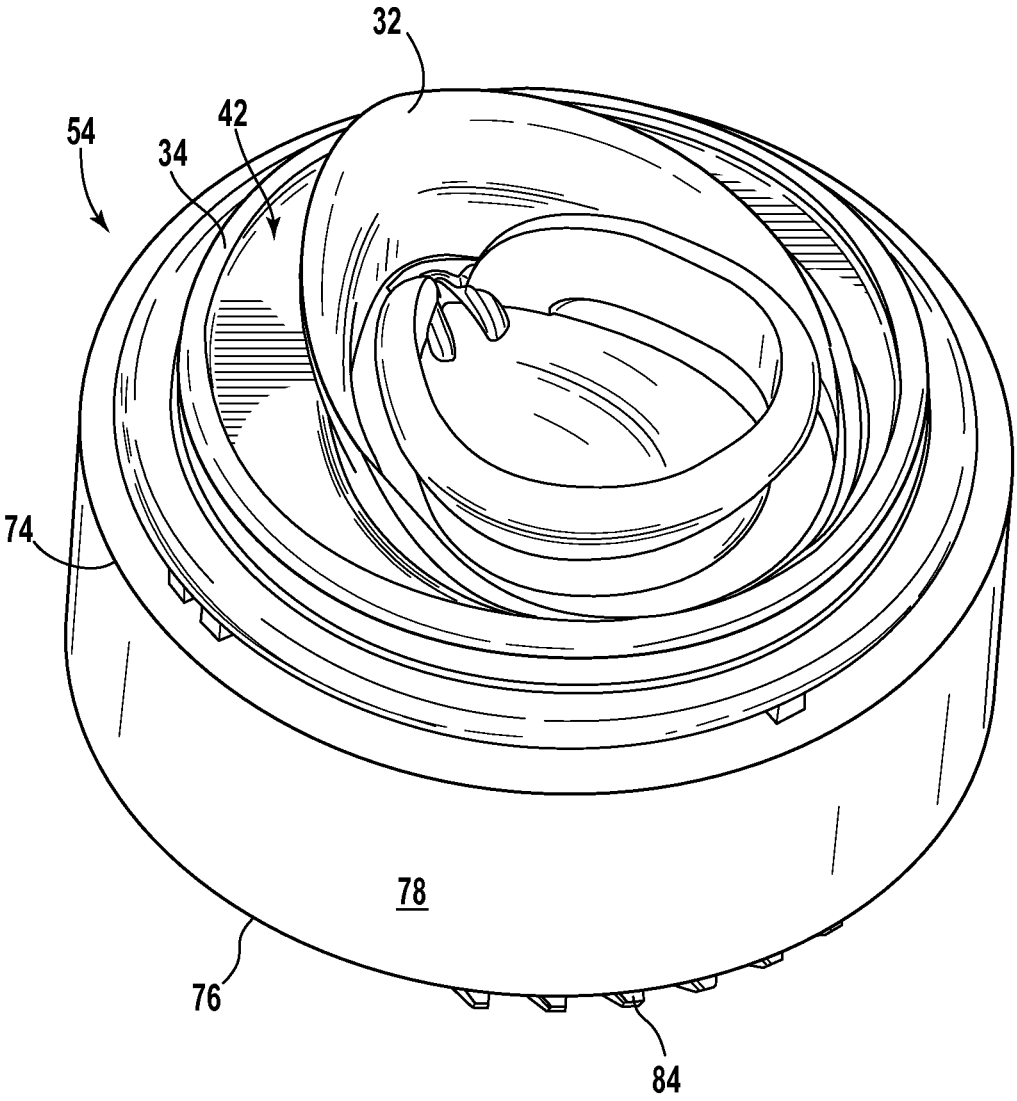
FIG. 5A is a top perspective drawing of the inner core of FIG. 4, according to an exemplary embodiment.
Figure 5B:
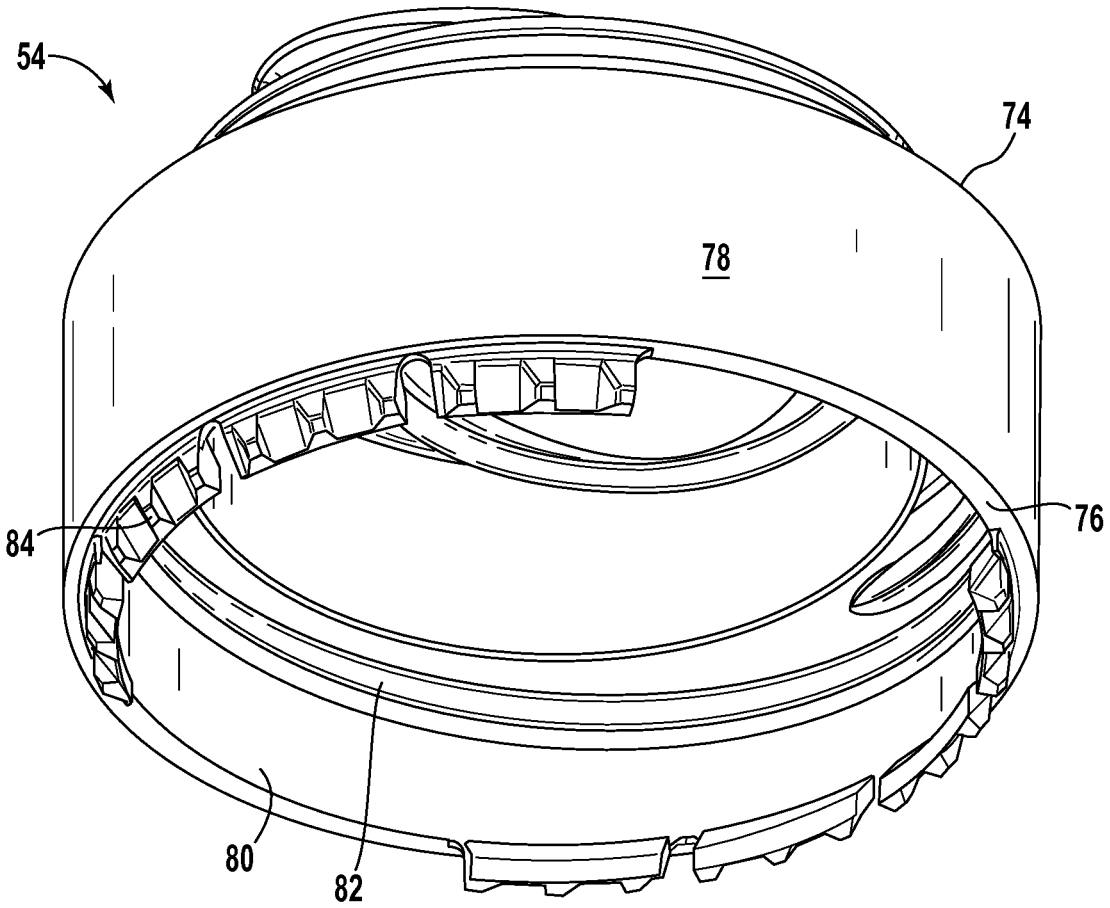
FIG. 5B is a bottom perspective drawing of the inner core of FIG. 4, according to an exemplary embodiment.

Referring now to FIGS. 5A-5B, a top perspective view (FIG. 5A) and a bottom perspective view (FIG. 5B) of inner core 54 is shown, according to an exemplary embodiment. Inner core 54 is shown to include an upper rim 74, a lower rim 76, and a side wall 78. In some embodiments, upper rim 74 and lower rim 76 are circular or substantially circular. Side wall 78 may be a circumferential wall (e.g., cylindrical, annular, etc.) connecting upper rim 74 and lower rim 76. In some embodiments, inner core 54 has an open bottom. Side wall 78 may form a skirt which fits over an open end of receptacle 14.

In some embodiments, inner core 54 includes one or more attachment features (e.g., a coupling component, an attachment structure, etc.) configured to secure closure 12 to receptacle 14. For example, inner core 54 is shown to include threading 82 and ratchet teeth 84. Threading 82 may be located along an inner surface 80 of side wall 78. Threading 82 may engage a corresponding attachment feature of receptacle 14 (e.g., matching threading) to fasten closure 12 to an open end of receptacle 14. Ratchet teeth 84 are shown extending from lower rim 76. Ratchet teeth 84 may engage an outer surface of receptacle 14 when inner core 54 is attached thereto. Ratchet teeth 84 may prevent inner core 54 from rotating relative to receptacle 14 once attached.

Figure 6:
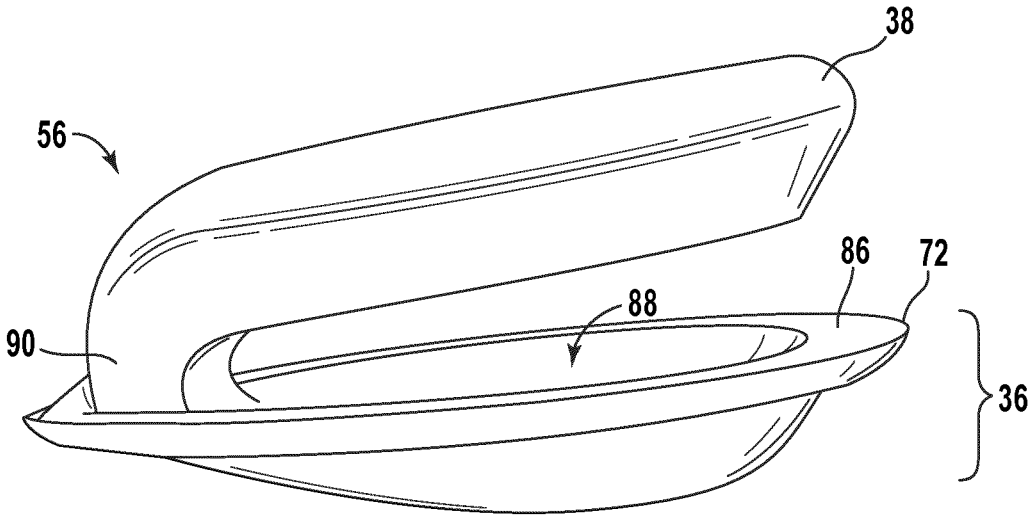
FIG. 6 is a side perspective drawing the break-away pull tab of FIG. 4, according to an exemplary embodiment.

Referring now to FIG. 6, a side perspective view of pull tab 56 is shown, according to an exemplary embodiment. Pull tab 56 is shown to include a break-away tab 36 and a pull ring 38. In some embodiments, pull ring 38 is offset above break-away tab 36. Pull ring 38 may be aligned or substantially aligned with break-away tab 36. For example, a perimeter of pull ring 38 may be aligned or substantially aligned with a perimeter of break-away tab 36 (when viewed from above). Pull ring 38 may be fixedly attached to an upper surface of break-away tab 36 via one or more connection points 90. Connection points 90 may be configured to translate a pulling force to break-away tab 36 when the pulling force is applied to pull ring 38.

Break-away tab 36 is shown to include an upper surface 86 and a concave depression 88. Concave depression 88 may be recessed into upper surface 86 and may be configured to receive an object for applying a pulling force to pull ring 38. For example, concave depression 88 may be shaped to receive a human finger or other tool for applying a pulling force to pull ring 38. Concave depression 88 may provide a spacing between upper surface 86 to allow pull ring 38 to be gripped more easily.

Figure 7:
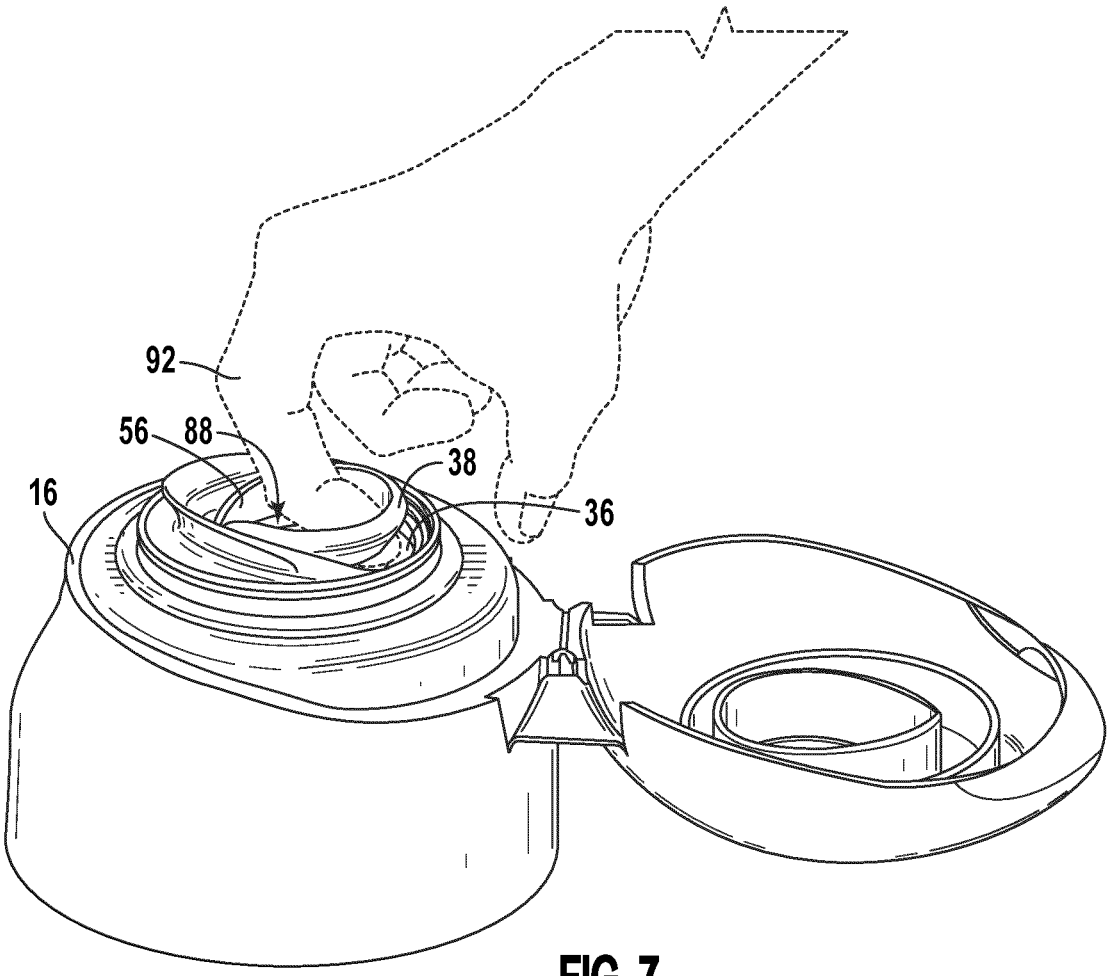
FIG. 7 is a drawing of the closure of FIG. 1 with the break-away pull tab attached to base portion and a user applying a force to the pull tab to separate the pull tab from the base portion, according to an exemplary embodiment.
Figure 8:
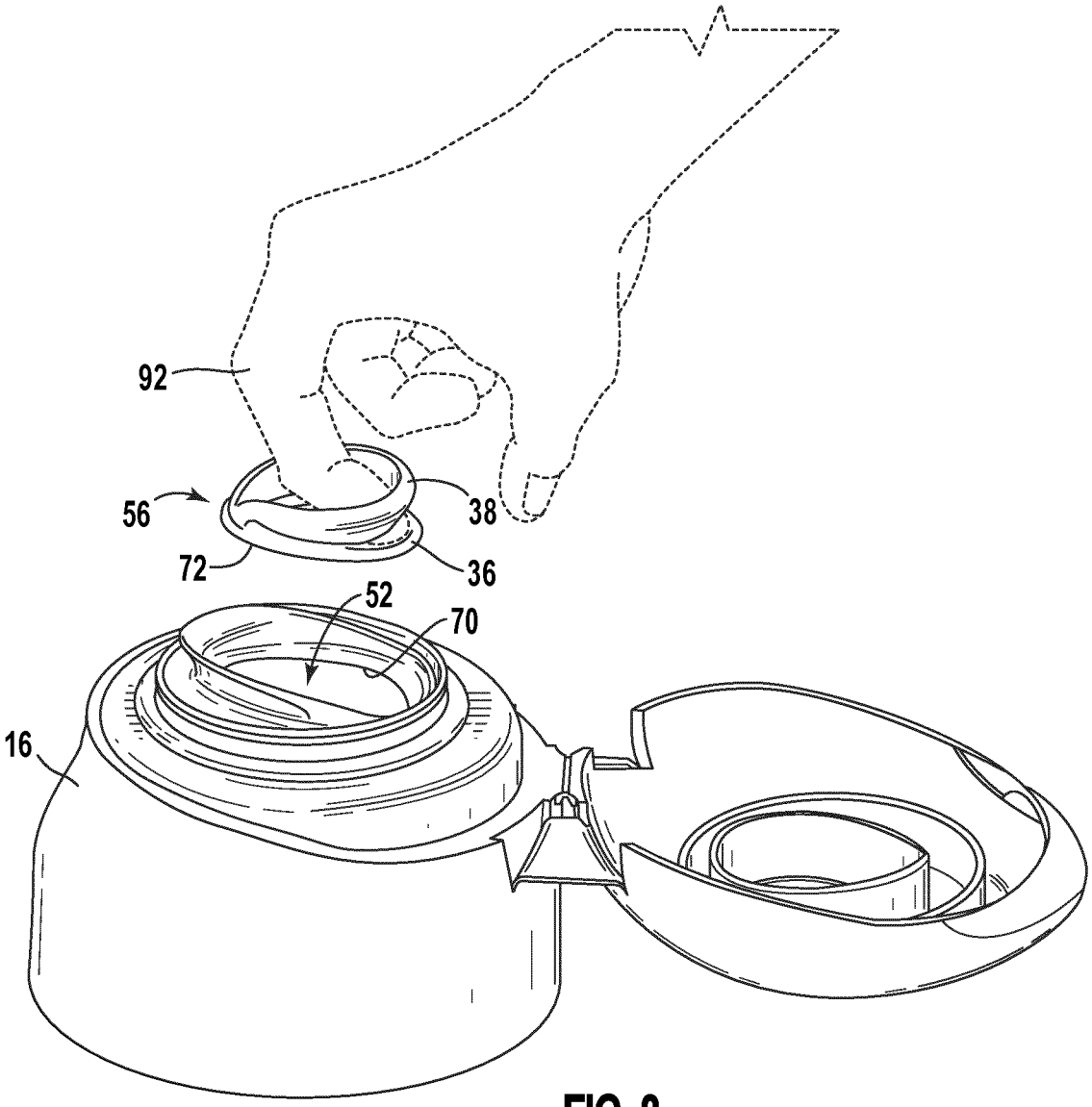
FIG. 8 is a drawing of the closure of FIG. 1 with the break-away pull tab separated from the base portion, according to an exemplary embodiment.

Referring now to FIGS. 7-8, a pair of drawings illustrating pull tab 56 detaching from base portion 16 is shown, according to an exemplary embodiment. Pull tab 56 may be an integral part of base portion 16 when base portion 16 is formed. For example, upon initial formation, outer rim 72 of break-away tab 36 may be attached to base portion 16 along a perimeter 70 of dispensing aperture 52. Pull tab 56 can be separated from base portion 16 (e.g., by a user) by applying a pulling force to pull ring 38.

As shown in FIG. 7, a pulling force can be applied to pull ring 38 by placing a finger 92 or other tool between pull ring 38 and break-away tab 36 and pulling in an upward direction. Finger 92 may be placed at least partially in concave depression 88 to facilitate gripping and/or applying an upward force to pull ring 38. As shown in FIG. 8, the pulling force may cause pull tab 56 to completely detach from base portion 16, thereby exposing dispensing aperture 52. Upon separating pull tab 56 from inner core 54, the contents of container 10 can be dispensed via dispensing aperture 52.

Figure 9:
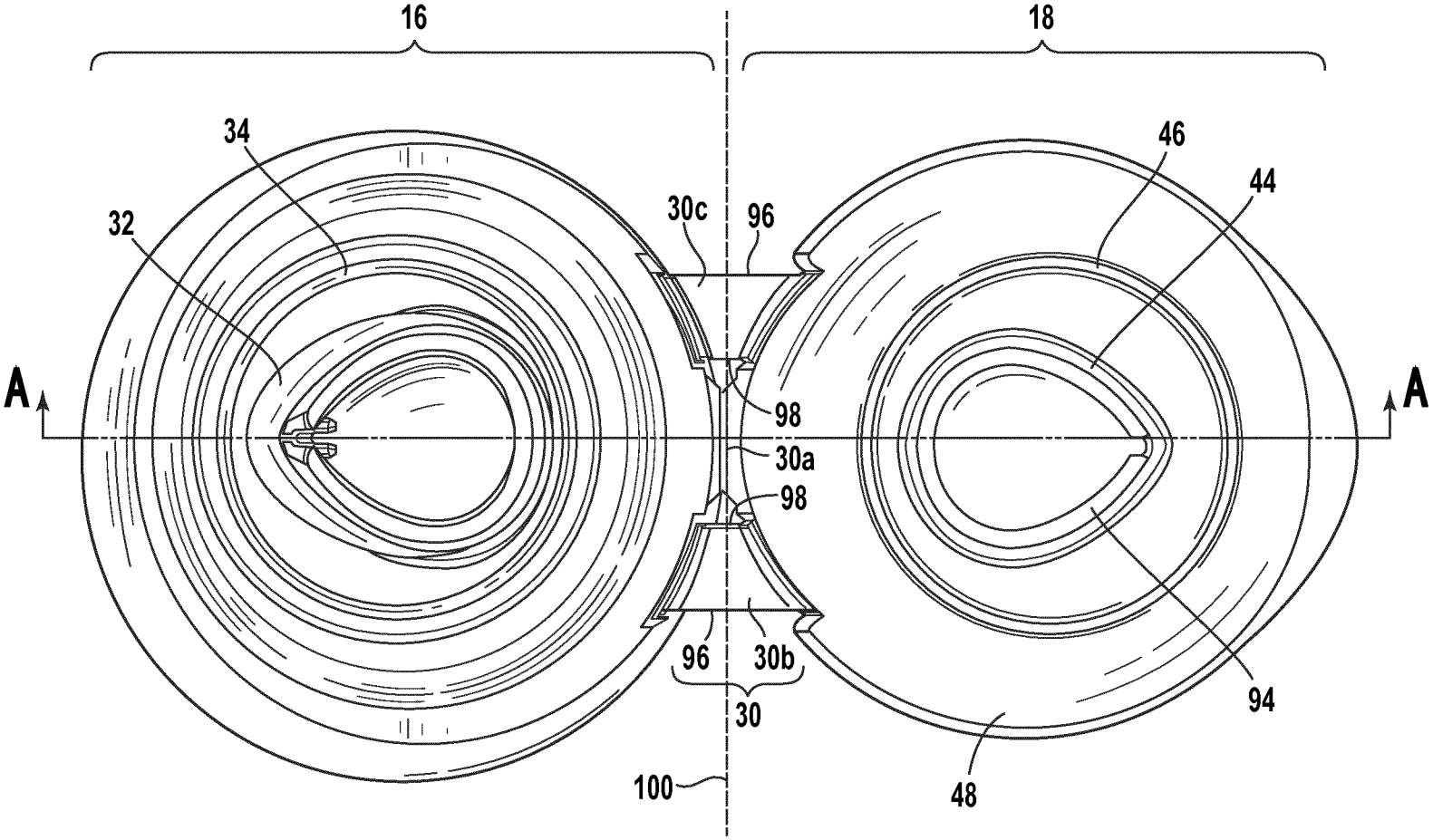
FIG. 9 is a plan view drawing of the closure of FIG. 1 with the cap portion in the open position, according to an exemplary embodiment.

Referring now to FIG. 9, a plan view of closure 12 with cap portion 18 in the open position is shown, according to an exemplary embodiment. In some embodiments, raised pour lip 32 and inner perimeter seal 44 have corresponding perimeter shapes. For example, raised pour lip 32 and inner perimeter seal 44 are shown having mirrored teardrop-shaped perimeters. The perimeter shapes of raised pour lip 32 and inner perimeter seal 44 may be mirrored across rotation axis 100. When cap portion 18 is rotated into the closed position (e.g., by rotating cap portion relative to base portion 16 about axis 100), inner perimeter seal 44 may engage (e.g., align with, contact, etc.) raised pour lip 32, thereby forming a perimeter seal around dispensing aperture 52.

Raised rib 34 and outer perimeter seal 46 are shown having mirrored circular perimeters. Raised rib 34 may circumscribe raised pour lip 32 and outer perimeter seal 46 may circumscribe inner perimeter seal 44. The perimeter shapes of raised rib 34 and outer perimeter seal 46 may be mirrored across rotation axis 100. When cap portion 18 is rotated into the closed position, outer perimeter seal 44 may engage raised rib 34, thereby forming a perimeter seal around raised pour lip 32 and drain-back channel 42.

Still referring to FIG. 9, cap portion 18 is shown to include an anti-fling rib 94. Anti-fling rib 94 may extend from inner surface 48 of cap portion 18. In some embodiments, anti-fling rib 94 is surrounded by at least one of inner perimeter seal 44 and outer perimeter seal 46. For example, anti-fling rib 94 is shown forming a closed shape around an inner perimeter of inner perimeter seal 44. Anti-fling rib 94 may curve radially inward (e.g., toward the center of the area bounded by perimeter seal 44) as anti-fling rib 94 extends from inner surface 48. For example, a vertical cross-section of anti-fling rib 94 may form an arc (e.g., an approximately 90 degree arc) as anti-fling rib 94 extends from inner surface 48. In various embodiments, anti-fling rib 94 extends along an entire perimeter of inner perimeter seal 44 or a portion of the perimeter of inner perimeter seal 44.

Anti-fling rib 94 may prevent any material (e.g., liquid, residue, granulated matter, etc.) which has accumulated on inner surface 48 from being ejected from cap portion 18 if cap portion 18 is moved rapidly. For example, anti-fling rib 94 may restrain the material from outward horizontal and vertical movement around the perimeter of inner perimeter seal 44. Anti-fling rib 94 may capture accumulated material and cause such material to drop back into receptacle 14 (e.g., via dispensing aperture 52) when cap portion 18 is returned to the closed position.

Still referring to FIG. 9, hinges 30 are shown in greater detail, according to an exemplary embodiment. In some embodiments, hinges 30 include a central hinge 30*a* and one or more periphery hinges (e.g., hinges 30*b* and 30*c*). As shown in FIG. 9, periphery hinges 30*b* and 30*c* may be located at either side of central hinge 30*a* (i.e., surrounding central hinge 30*a*). Periphery hinges 30*b* and 30*c* may stabilize and support cap portion 18 as cap portion 18 is moved between the open position and the closed position.

In some embodiments, central hinge 30*a* is linear or substantially linear. For example, central hinge 30*a* may attach to base portion 16 and/or cap portion 18 at an intersection defined by a straight line. Periphery hinges 30*b* and 30*c* may attach to base portion 16 and/or cap portion 18 at an intersection defined by a curved line. In some embodiments, periphery hinges 30*b* and 30*c* may be trapezoidal or substantially trapezoidal. For example, periphery hinges 30*b* and 30*c* may have a first edge (e.g., outer edge 96) and a second edge (e.g., inner edge 98). Outer edge 96 may be longer than inner edge 98.

Figure 10:
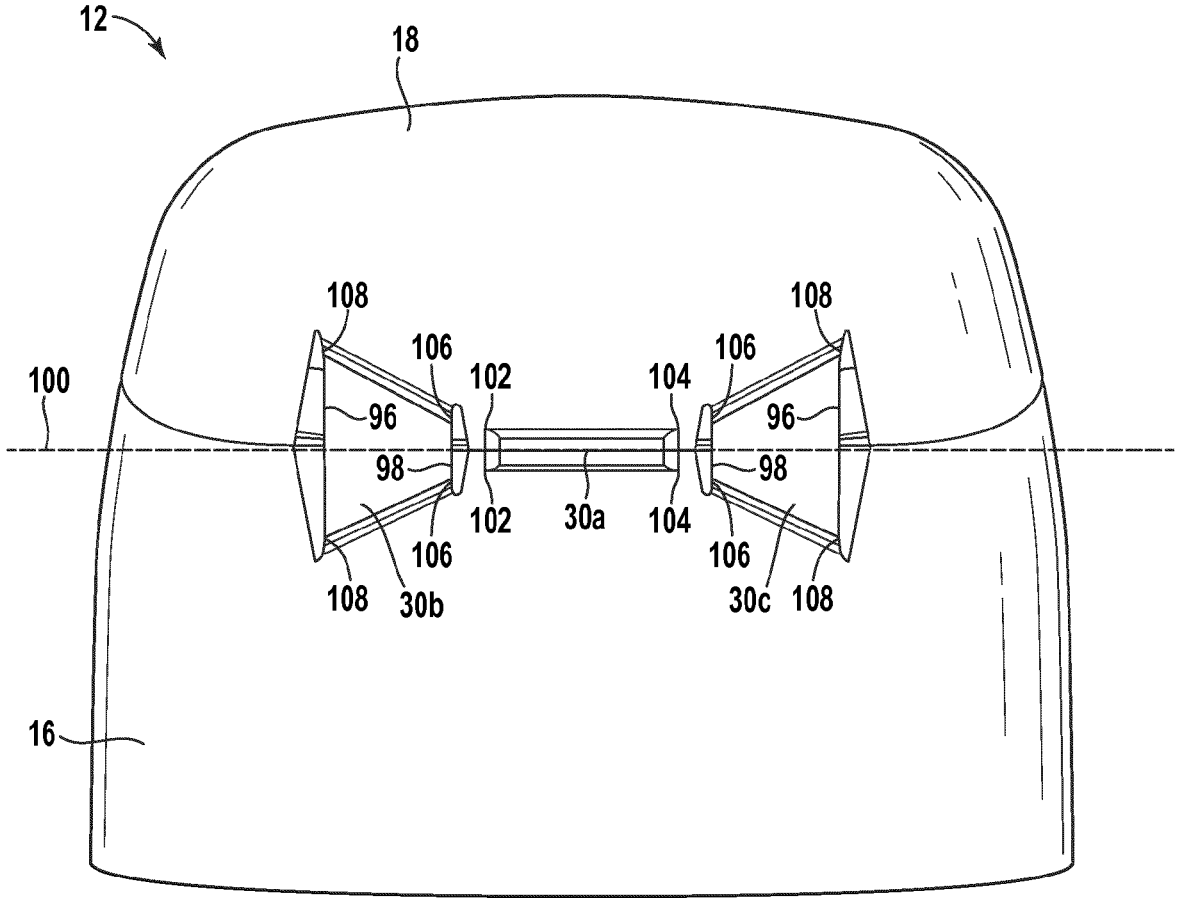
FIG. 10 is a rear elevation drawing of the closure of FIG. 1 with the cap portion in the closed position, according to an exemplary embodiment

Referring now to FIG. 10, a rear elevation view of closure 12 with cap portion 18 in the closed position is shown, according to an exemplary embodiment. Hinges 30 may be vertically centered relative to rotation axis 100. Central hinge 30*a* may attach to base portion 16 and/or cap portion 18 along a line segment defined by a first end point 102 (e.g., at a first end of the line segment) and a second end point 104 (e.g., at a second end of the line segment). First end point 102 and second end point 104 may be separated (e.g., offset) from rotation axis 100 by equal or substantially equal distances.

Periphery hinges 30*b* and 30*c* may attach to base portion 16 and/or cap portion 18 along a line segment defined by a first end point 106 (e.g., at an inner end of the line segment) and a second end point 108 (e.g., at an outer end of the line segment). First end point 106 and second end point 108 may be separated from rotation axis 100 by different distances. For example, as shown in FIG. 10, the distance between first end point 106 and rotation axis 100 is less than the distance between second end point 108 and rotation axis 100.

Figure 11:
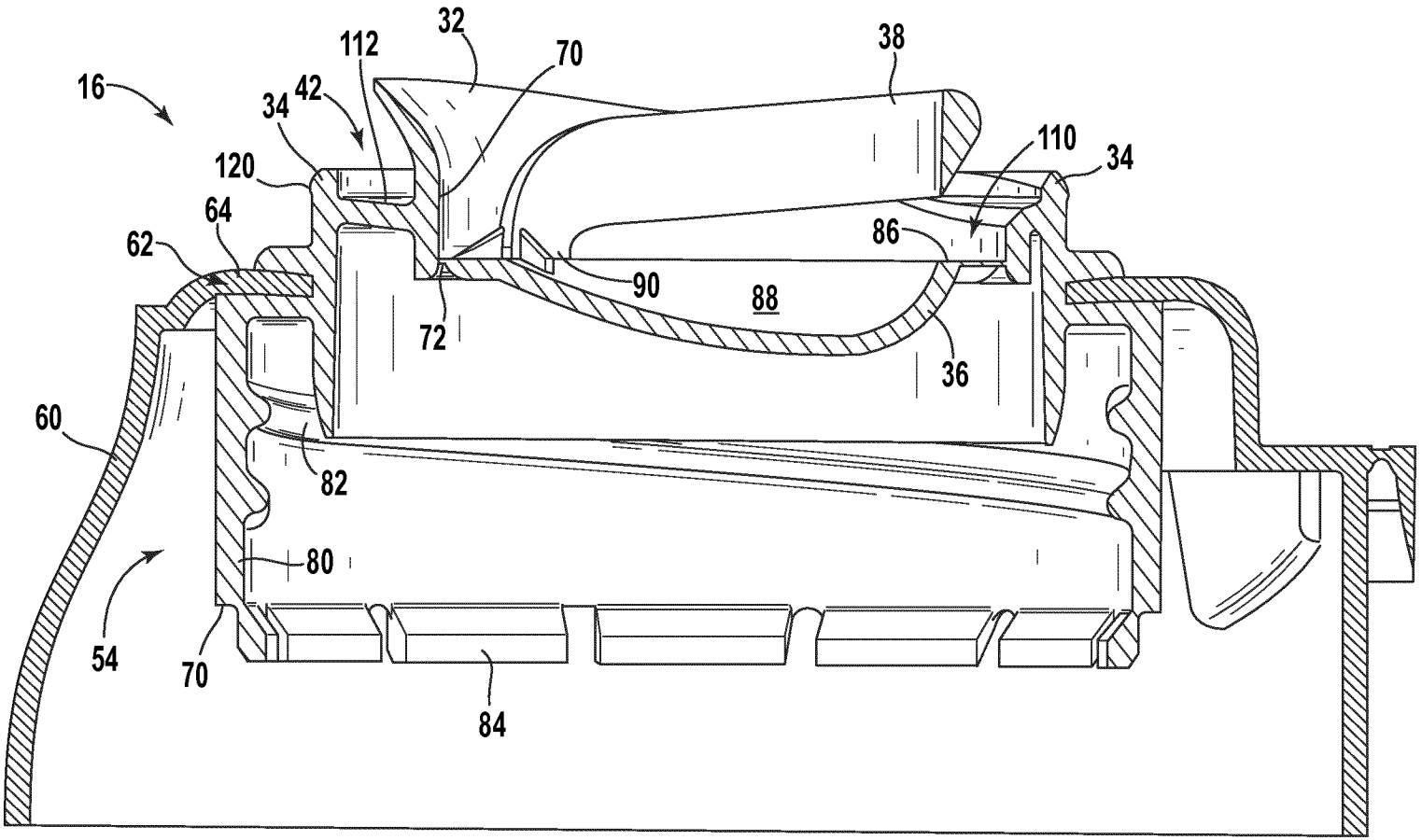
FIG. 11 is a cross-sectional elevation drawing of the base portion of FIG. 2, according to an exemplary embodiment.
Figure 12:
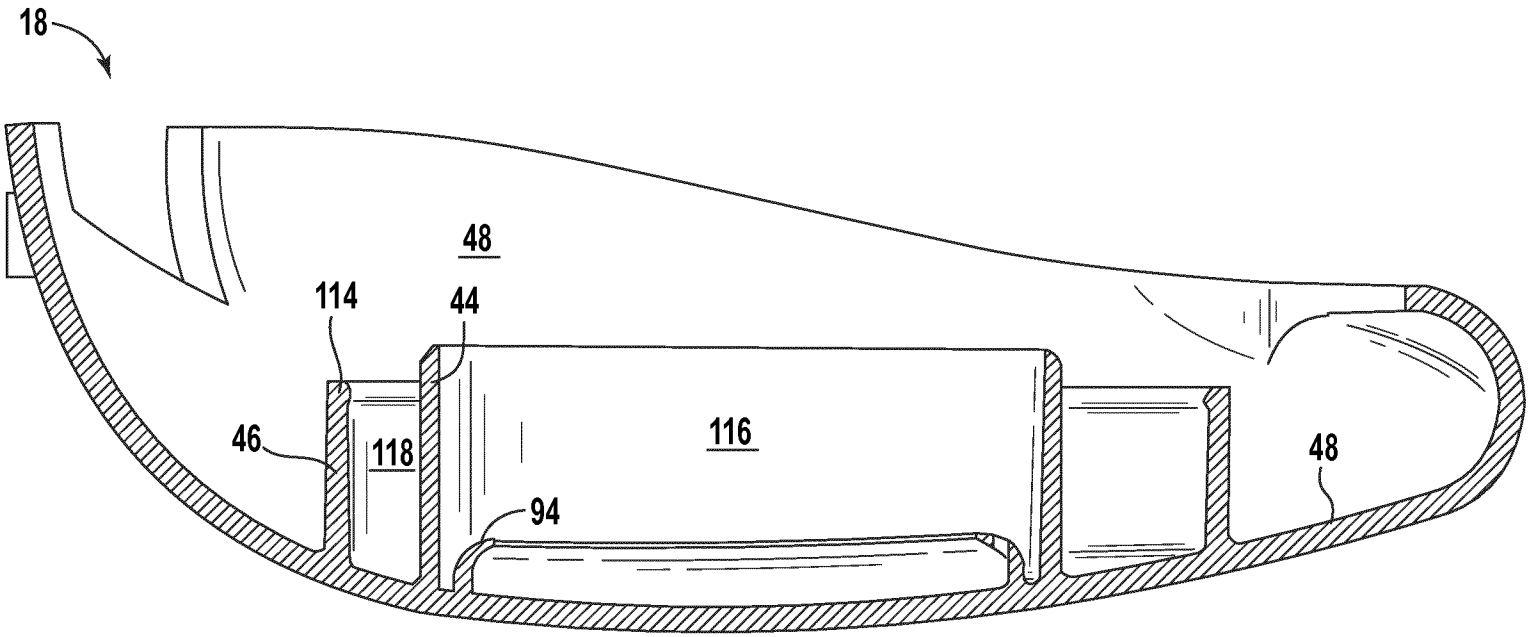
FIG. 12 is a cross-sectional elevation drawing of the cap portion of FIG. 2, according to an exemplary embodiment.
Figure 13:
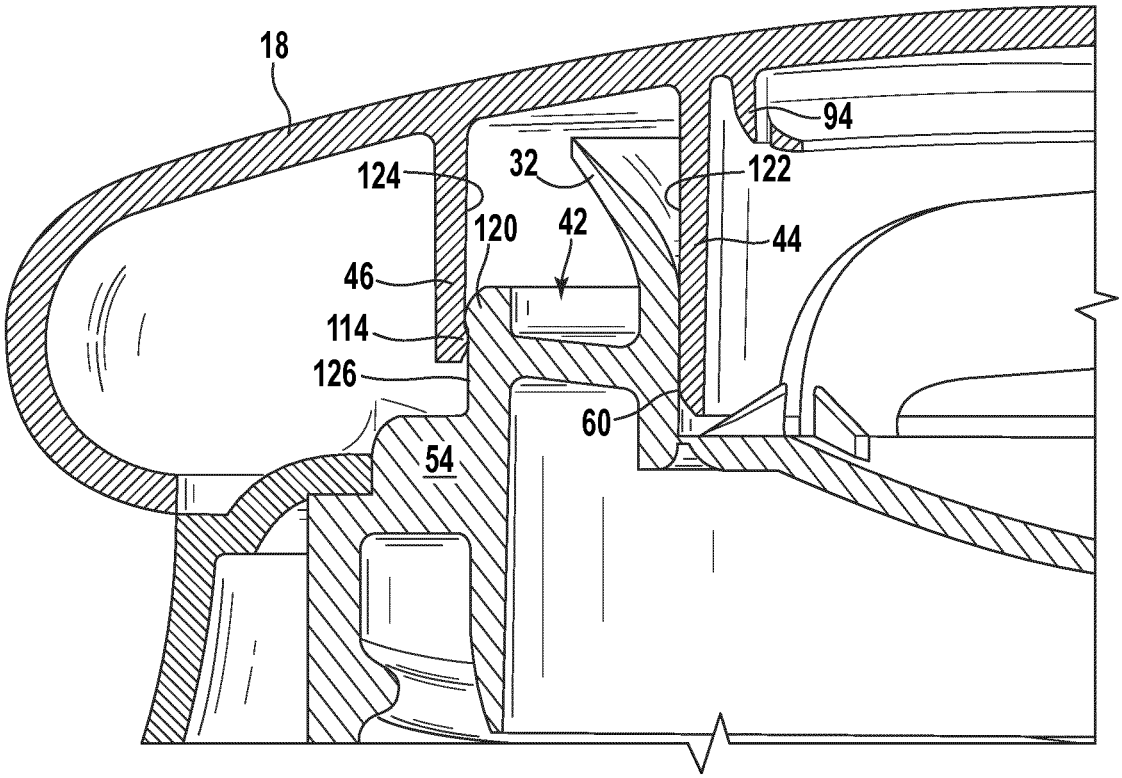
FIG. 13 is a cross-sectional elevation drawing of the closure of FIG. 1 with the cap portion in the closed position, according to an exemplary embodiment

Referring now to FIGS. 11-13, several cross-sectional drawings of closure 12 are shown, according to an exemplary embodiment. FIGS. 11-13 are vertical cross sections taken along plane AA (shown in FIG. 9). Referring particularly to FIG. 11, a cross section of base portion 16 is shown, according to an exemplary embodiment. Base portion 16 is shown to include inner core 54 and outer shell 60. Inner core 54 is shown to include raised pour lip 32, raised rib 34, and drain-back channel 42 between raised pour lip 32 and raised rib 34. Raised rib 34 may include a snap ring 120 along a circumferential surface of raised rib 34. Snap ring 120 may be configured to engage a corresponding snap ring (e.g., snap ring 114, shown in FIG. 12) on outer perimeter seal 46 when cap portion 18 is in the closed position.

Drain-back channel 42 is shown having a sloped lower surface 112 which causes excess material collected in drain-back channel 42 to be guided toward drainage location 110. Drainage location 110 may be an area of drain-back channel 42 at which the excess material can drain back into receptacle 14. For example, drainage location 110 may be an area between raised pour lip 32 and raised rib 34 at which raised pour lip 32 has zero or minimal height relative to lower surface 112.

Still referring to FIG. 11, base portion 16 is shown with pull tab 56 occupying dispensing aperture 52. Pull tab 56 is shown to include break-away tab 36 and pull ring 38. Pull ring 38 may be fixedly attached to break-away tab 36 at connection point 90. Pull tab 56 is shown to include concave depression 88 recessed into upper surface 86 of break-away tab 36. An outer perimeter 72 of break-away tab 36 is shown attached to an inner perimeter 70 of raised pour lip 32 and/or the dispensing aperture. In some embodiments, the thickness of break-away tab 36 along perimeter 72 may be less than the thickness of break-away tab 36 at other locations. The thinner portion of break-away tab 36 along perimeter 72 may facilitate break-away tab 36 detaching from base portion 16 along perimeters 70 and 72 when a pulling force is applied to pull ring 38.

Inner core 54 is shown to include threading 82 along inner surface 80 and ratchet teeth 84 attached to lower rim 76. Threading 82 may engage a corresponding attachment feature of receptacle 14 (e.g., matching threading) to fasten closure 12 to an open end of receptacle 14. Ratchet teeth 84 may engage an outer surface of receptacle 14 when inner core 54 is attached thereto. Ratchet teeth 84 may prevent inner core 54 from rotating relative to receptacle 14 once attached.

Still referring to FIG. 11, inner core 54 is shown to include groove 62 and outer shell 60 is shown to include tongue 64. Tongue 64 may fit within groove 62 to prevent inner core 54 from moving relative to outer shell 60. Tongue 64 may be formed by overmolding outer shell 60 onto inner core 54.

Referring now to FIG. 12, a cross section of cap portion 18 is shown, according to an exemplary embodiment. Cap portion 18 is shown to include a concave inner surface 48, inner perimeter seal 44, and outer perimeter seal 46. Inner perimeter seal 44 and outer perimeter seal 46 are shown extending from inner surface 48. Inner perimeter seal 44 may form an inner perimeter wall 116 and outer perimeter seal 46 may form an outer perimeter wall 118. Outer perimeter wall 118 may surround inner perimeter wall 116. Outer perimeter seal 46 and inner perimeter seal 44 have a seal thickness (e.g., from left to right in FIG. 12). In some embodiments, outer perimeter seal 44 is offset from inner perimeter seal 44 by an amount between twice the seal thickness and ten times the seal thickness.

In some embodiments, inner perimeter wall 116 is taller than outer perimeter wall 118. For example, inner perimeter wall 116 may have a first height in a direction of extension from inside surface 48 (e.g., upward in FIG. 12) and outer perimeter wall 118 may have a second height in the direction of extension from inside surface 48. The first height (i.e., the height of inner perimeter wall 116) may exceed the second height (i.e., the height of outer perimeter wall 118). In some embodiments, outer perimeter seal 46 is shorter than inner perimeter seal 44 by an amount between half the seal thickness and five times the seal thickness.

Outer perimeter seal 46 is shown to include a snap ring 114 along a circumferential surface of outer perimeter seal 46. Snap ring 114 may be configured to engage a corresponding snap ring of raised rib 34 (e.g., snap ring 120) when cap portion 18 is in the closed position.

Still referring to FIG. 12, cap portion 18 is shown to include anti-fling rib 94 extending from inner surface 48. In some embodiments, anti-fling rib 94 is surrounded by at least one of inner perimeter seal 44 and outer perimeter seal 46. Anti-fling rib 94 may curve radially inward (e.g., toward the center of the area bounded by perimeter seal 44) as anti-fling rib 94 extends from inner surface 48. For example, the cross-section of anti-fling rib 94 is shown forming an inward-curving arc (e.g., an approximately 90 degree arc) as anti-fling rib 94 extends from inner surface 48.

Referring now to FIG. 13, a cross section of closure 12 with cap portion 18 in the closed position is shown, according to an exemplary embodiment. When cap portion 18 is moved into the closed position, inner perimeter seal 44 may engage raised pour lip 32. In some embodiments, an outer perimeter surface 122 of inner perimeter seal 44 aligns with and/or contacts an inner perimeter surface of raised pour lip 32 (i.e., surface 70) when inner perimeter seal 44 engages raised pour lip 32. Inner perimeter seal 44 may form a sealed perimeter wall (e.g., perimeter wall 116) around the dispensing aperture when cap portion 18 is in the closed position.

When cap portion 18 is moved into the closed position, outer perimeter seal 46 may engage raised rib 34. In some embodiments, an outer perimeter surface 126 of raised rib 34 aligns with and/or contacts an inner perimeter surface 124 of outer perimeter seal 46 when outer perimeter seal 46 engages raised rib 34. Outer perimeter seal 46 may form a sealed perimeter wall (e.g., perimeter wall 118) around the drain-back channel 42 and the dispensing aperture when cap portion 18 is in the closed position.

Still referring to FIG. 13, snap ring 114 is shown in an engaged position relative to snap ring 120 (e.g., below snap ring 120 in FIG. 13). Snap ring 114 may move into the engaged position when cap portion 18 is moved into the closed position. For example, as cap portion 18 is moved into the closed position, snap ring 114 may contact snap ring 120. The contact between snap ring 114 and snap ring 120 may apply an outward force to snap ring 114, thereby causing perimeter seal 46 to flex in an outward direction (e.g., to the left in FIG. 13). When cap portion 18 is completely closed, snap ring 114 may slide into the engaged position below snap ring 120. In some embodiments, a transition into the engaged position may be accompanied by an audible and/or tactile feedback (e.g., click or snap).

Snap rings 114 and 120 may be configured to hold cap portion 18 in the closed position. The elasticity of cap portion 18 and/or base portion 16 may prevent snap ring 114 from moving in an upward direction from the engaged position unless a force of sufficient magnitude is applied to cap portion 118.

It is important to note that the construction and arrangement of the elements of the closure for a container provided in this specification are illustrative only. Although only a few exemplary and alternative embodiments of the present invention have been described in detail in this disclosure, those skilled in the art who review this disclosure will readily appreciate that many modifications are possible in these embodiments (e.g., variations in features such as orientation of flaps, skirts and corresponding recesses; variations in sizes, structures, shapes, dimensions and proportions of the seals, recesses, projections, skirts, stiffeners and other elements; variations in the hinge arrangements, number of hinges, configuration and operation of closure structures and systems, arrangement and proportioning of apertures and other openings, use of materials, colors, combinations of shapes, etc.) without materially departing from the novel teachings and advantages of the invention.

In any embodiment, the closure may be adapted and sized for use on any type of receptacle, or for use on receptacles of different sizes, and/or the closure may be used for dispensing a variety of different materials or contents. The base portion may be adapted for use on a receptacle with a square, rectangular, or other shaped mouth or opening, or the dispensing aperture may be replaced with more than one opening (e.g., a tear-drop, triangular, rectangular, circular, oval, or other shaped openings) and be configured to pour one or more of a variety of different materials. According to other alternative embodiments, the closure may be adapted for coupling to a receptacle by a threaded interface or by a snap-on ring or other press-fit engagement structure. According to other alternative embodiments, inner core and the pull tab may be formed as separate members.

It is readily apparent that each of the different embodiments and elements of the closure may be provided in a wide variety of shapes, sizes, thicknesses, combinations, etc. It is also readily apparent that the interfaces and structures for sealing and/or retaining the flap may be designed with any profile and configuration suitable for securing the flap to the body portion. Accordingly, all such modifications are intended to be within the scope of the inventions as defined in any appended claims.

Elements shown as integrally formed may be constructed of multiple parts or elements. The elements and assemblies may be constructed from any of a wide variety of materials that provide sufficient strength or durability, in any of a wide variety of colors, textures, and combinations.

It should further be noted that for purposes of this disclosure, the terms "coupled" or "attached" mean the joining of two members (e.g., surfaces, edges, panels, etc.) directly or indirectly to one another. Such joining may be stationary in nature or moveable in nature. Such joining may be achieved with the two members or the two members and any additional intermediate members. Such joining may be permanent in nature (e.g., fixedly attached, secured, bonded, etc.) or temporary in nature (e.g., releasably attached, engaged, etc.). Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner.

The order or sequence of any process or method steps may be varied or re-sequenced according to alternative embodiments. In any claims, any means-plus-function clause is intended to cover the structures described herein as performing the recited function and not only structural equivalents but also equivalent structures. All such modifications are intended to be included within the scope of the present disclosure. Other substitutions, modifications, changes and omissions may be made in the design, operating configuration and arrangement of the exemplary and other alternative embodiments without departing from the spirit of the present inventions as expressed in any appended claims.

What is claimed is:

1. A closure for a receptacle having a top opening, the closure comprising:

a base portion attachable to an upper portion of the receptacle to cover the top opening, the base portion comprising:

a dispensing aperture, a raised pour lip formed along a perimeter of the dispensing aperture, a raised rib forming a closed shape surrounding the raised pour lip, and a drain-back channel defined by a space between the raised pour lip and the raised rib, wherein the drain-back channel collects excess material dispensed via the dispensing aperture and drains the excess material back to the receptacle; and a cap portion hingedly connected to the base portion and rotatable relative to the base portion about the hinged connection between a closed position in which the cap portion covers the dispensing aperture and an open position in which the cap portion uncovers the dispensing aperture;

wherein a first material forms an integrated inner core of the base portion, the integrated inner core comprising the raised pour lip, the raised rib surrounding the raised pour lip, and one or more features that attach the base portion to the receptacle; and wherein a second material forms an integrated component comprising the cap portion and an outer shell of the base portion, wherein the cap portion is hingedly connected to the outer shell of the base portion.

2. The closure of claim 1, wherein the perimeter of the dispensing aperture comprises a portion occupied by the raised pour lip and a portion not occupied by the raised pour lip;

wherein the drain-back channel drains the excess material back to the receptacle through the portion of the perimeter of the dispensing aperture not occupied by the raised pour lip.

3. The closure of claim 1, further comprising:

a break-away tab releasably attached to the base portion along an inner perimeter of the dispensing aperture and covering the dispensing aperture in a sealed arrangement; and a pull ring fixedly attached to an upper surface of the break-away tab, wherein the pull ring separates the break-away tab from the base portion when a pulling force is applied to the pull ring;

wherein the break-away tab and the pull ring completely detach from the base portion when the break-away tab is separated therefrom.

4. The closure of claim 3, wherein a perimeter of the pull ring is substantially aligned with a perimeter of the break-away tab and wherein the pull ring is offset above the break-away tab.

5. The closure of claim 3, wherein the break-away tab comprises a concave depression recessed into the upper surface thereof, wherein the concave depression receives an object for applying the pulling force to the pull ring.

6. The closure of claim 1, wherein the cap portion comprises:

an inner perimeter seal that engages a perimeter of the raised pour lip when the cap portion is in the closed position; and an outer perimeter seal that engages a perimeter of the raised rib when the cap portion is in the closed position.

7. The closure of claim 6, wherein the raised rib and the outer perimeter seal are circular.

8. The closure of claim 6, wherein the outer perimeter seal is configured to shrink in a uniform manner when the closure is formed.

9. The closure of claim 6, wherein the inner perimeter seal and the outer perimeter seal extend from an inside surface of the cap portion, the inner perimeter seal forming an inner perimeter wall and the outer perimeter seal forming an outer perimeter wall surrounding the inner perimeter wall;

wherein the inner perimeter wall has a first height in a direction of extension from the inside surface and the outer perimeter wall has a second height in the direction of extension from the inside surface, the first height exceeding the second height.

10. The closure of claim 6, wherein the outer perimeter seal comprises a first snap ring along a circumferential surface of the outer perimeter seal;

wherein the raised rib comprises a second snap ring along a circumferential surface of the raised rib;

wherein the first snap ring engages the second snap ring when the cap portion is moved into the closed position, the snap rings holding the cap portion in the closed position.

11. The closure of claim 6, wherein the outer perimeter seal and the inner perimeter seal have a seal thickness;

wherein the outer perimeter seal is offset from the inner perimeter seal by an amount between twice the seal thickness and ten times the seal thickness.

12. The closure of claim 6, wherein the outer perimeter seal and the inner perimeter seal have a seal thickness;

wherein the outer perimeter seal is shorter than the inner perimeter seal by an amount between half the seal thickness and five times the seal thickness.

13. A closure for a receptacle having a top opening, the closure comprising:

a base portion attachable to an upper portion of the receptacle to cover the top opening, the base portion comprising a dispensing aperture, an inner core, and an outer shell overmolded onto the inner core, wherein the outer shell is restrained from lateral motion relative to the inner core by a tongue and groove fitting between the outer shell and the inner core, and wherein the outer shell is restrained from rotation relative to the inner core by one or more locking elements geometrically integrated with the tongue and groove fitting; and a cap portion hingedly connected to the base portion by a central hinge connection and a pair of periphery hinge connections surrounding the central hinge connection, wherein the cap portion is rotatable relative to the base portion about the hinged connections between a closed position in which the cap portion covers the dispensing aperture and an open position in which the cap portion uncovers the dispensing aperture.

14. The closure of claim 13, wherein the cap portion comprises:

a perimeter seal extending from an inner surface of the cap portion and forming a seal around the dispensing aperture when the cap portion is in the closed position, and an anti-fling rib extending from the inner surface of the cap portion and forming a closed shape surrounded by the perimeter seal, the anti-fling rib having a curved profile which curves radially inward as the anti-fling rib extends from the inner surface.

15. The closure of claim 13, wherein the base portion comprises an attachment feature that secures the base portion to the receptacle, the attachment feature comprising at least one of threading and ratchet teeth.

16. The closure of claim 13, further comprising:

a raised pour lip formed along a perimeter of the dispensing aperture; and an inner perimeter seal that engages a perimeter of the raised pour lip when the cap portion is in the closed position.

17. The closure of claim 13, further comprising a drain-back channel that collects excess material dispensed via the dispensing aperture and drains the excess material back to the receptacle.

18. The closure of claim 13, further comprising a raised rib forming a closed shape surrounding the dispensing aperture and offset from a perimeter of the dispensing aperture.

* * * * *